United States Patent [19]

Allen

[11] Patent Number: 4,869,599

[45] Date of Patent: Sep. 26, 1989

[54] DRINK CUP SUPPORT

[76] Inventor: Edwin J. Allen, 304 Burns Ave., Cincinnati, Ohio 45215

[21] Appl. No.: 209,219

[22] Filed: Jun. 20, 1988

[51] Int. Cl.[4] ..... B65D 30/22

[52] U.S. Cl. ..... 383/38; 206/427; 229/120.36; 229/120.37

[58] Field of Search ..... 229/120.23, 120.35, 229/120.36, 120.37, 120.12, 41 R; 206/427; 383/38; 217/22, 30, 31, 32, 33, 23

[56] References Cited

U.S. PATENT DOCUMENTS

| | | | |
|---|---|---|---|
| 1,158,349 | 10/1915 | Whalen . | |
| 1,349,535 | 8/1920 | Smith . | |
| 1,628,718 | 5/1927 | Fritzsche . | |
| 1,849,083 | 3/1932 | Grimes | 217/22 |
| 1,983,418 | 12/1934 | Thurmer | 206/427 |
| 1,990,829 | 2/1935 | Jensen | 229/120.35 |
| 2,269,796 | 1/1942 | Strasser . | |
| 2,517,767 | 8/1950 | Cody | 229/120.23 |
| 2,749,012 | 6/1956 | Beach | 229/120.23 |
| 2,900,120 | 8/1959 | Wichman | 229/120.37 |
| 3,675,345 | 7/1972 | Abrams | 229/120.36 |
| 3,963,171 | 6/1976 | Lindsay | 229/120.23 |
| 3,986,656 | 10/1976 | November | 229/120.35 |
| 4,037,775 | 7/1977 | Bamburg et al. | 229/120.37 |
| 4,219,146 | 8/1980 | Skaggs et al. | 229/120.23 |
| 4,509,640 | 4/1985 | Joyce . | |
| 4,542,826 | 9/1985 | Adams | 206/427 |

*Primary Examiner*—Stephen P. Garbe

*Attorney, Agent, or Firm*—Wood, Herron & Evans

[57] ABSTRACT

A support which is insertable into a bag to enable drink cups or other containers to be carried upright in the bag. The support comprises at least two vertical panels which are hinged together, and which define partitions that meet at and extend outwardly from the hinge line. Floors are foldably hinged between adjacent partitions. Wedge-shaped, cup-receiving compartments are formed between the angulated partitions, and are closed at their outer ends by the walls of the bag. The support, in collapsed configuration, is inserted downwardly into a bag and is erected by swinging the partitions apart and seating the outer ends of the partitions in corners of the bag to maintain the bag open. The support floor resides against the bottom of the bag.

17 Claims, 4 Drawing Sheets

DRINK CUP SUPPORT

FIELD OF THE INVENTION

This invention relates to a support for use within a bag, to enable one or more drink cups or other contains to be carried upright in the bag.

BACKGROUND OF THE INVENTION

When food and drinks are purchased for carryout, the food is usually packaged in a paper bag and the drinks cups are delivered separately. As experience often teaches the hard way, it is difficult to carry a drink cup safely in a bag; it is better to carry the drink separately. The problem is, of course, that the drink cup is unstable. It flares outwardly above a relatively small base and has a high center of gravity due to the liquid in it. The problem is compounded by the facts that the bottom of the bag is not rigid and so permits the cup to tip; and the cup tends to drip moisture on the bottom of the bag and thereby weaken it. Because of these factors, a drink cup being carried inside a bag often seems determined to tip over. Sometimes a separate carrier of cardboard or molded pulp is provided by the food seller to hold drink cups separately, but so far as I am aware nothing has previously been available which enables a drink cup to be carried safely in an ordinary paper bag. The difficulty of carrying drink cups in a bag, or even separately, is such a nuisance as sometimes to deter one from ordering a drink along with a food purchase, particularly if car travel is involved.

There has, therefore, been a strong need for a structure which will permit one to carry one or more drink cups in a bag without tipping over, without weakening the bag from condensation or spillage, and without squeezing the cup to such an extent that the drink is displaced or the lid of the cup is popped off.

Realistically, the economics of the fast food industry are such that any structure for carrying a drink cup must be sufficiently inexpensive that it does not unduly cut into the profit on the drink. It also must be collapsible so that it can be stored in large numbers without large storage space requirements; and it must be easily and quickly openable or erectable in a bag, with one hand.

The industry has trended away from the concept of providing bags specially made for carrying drinks. In order to be practical, a drink carrier should be insertable, when needed, into a conventional bag of the type used for carrying out food, and should permit a drink to be carried alone or with food in the same bag, so as not to require two separate bags, or different types of bags, for carrying food and drink separately.

BRIEF DESCRIPTION OF THE INVENTION

The invention provides a container or drink cup support which is insertable into a bag, for example of the type commonly used at fast food carry outs, and which can be erected within a bag at point of use, when needed, to provide one or more compartments for carrying containers. In preferred form for use with a standard, so-called "twelve pound" bag, the support includes two generally rectangular wall elements or panels which are joined together along a central hinge line or join line so that, viewed in plan in erected or open configuration, the walls form an "X" shape. In effect, the panels form four partitions which radiate or project out from a single central hinge line. The panels are sized to fit diagonally (corner-to-corner) inside a bag. Adjacent pairs of the four partitions, at opposite ends of the X, form vertical, acutely angular (wedge-shaped) drink cup-receiving compartments between them. The compartments formed by the support are open at their ends; the walls of the bag provide end closures for the compartments when the support is opened in the bag. Each compartment has a foldable, cup supporting floor which is hinged to and connected between the bottom edges of the two partitions which form the respective compartment. Each floor has a central radial crease which projects outwardly from the join line and which bisects the angle between the two partitions of the respective compartment. The floor is foldable vertically (preferably upwardly) along this crease so as to lie parallel to the partitions when the support is collapsed, and is moved to a horizontal attitude (parallel to and facially adjacent the bag floor) as the support is erected. The floor pushes and holds the partitions apart when the support is erected so that the floor extends horizontally between the vertical partitions in erected configuration.

A floor camming tab preferably projects from each floor and is coplanar with it. In the collapsed configuration the cam tab projects angularly downwardly and outwardly from each partition of each compartment. When the support is inserted into a bag and the cam tabs engage the bottom of the bag, they cam the floor to horizontal position (perpendicular to the partitions), and simultaneously cause the partitions to move apart to open the compartments, thus automatically erecting the support for use.

The support is sized to fit neatly inside a conventional bag having a generally rectangular floor. When a support of the preferred form is erected, its two panels lie along the diagonals of the bag, engage the bag corners, and hold the bag walls taut. The floors of the support overlie the floor of the bag, holding the partitions apart and rigidifying the structure beneath the cup to resist tipping and providing a "double strength" floor so that moisture of the drink does not seep through and weaken the floor of the bag. The compartment walls help to prevent the cup walls from being squeezed by force acting on the outside of the bag, or by force from other cups or food inside the bag.

Other embodiments of the support have partitions that, seen in plan, form an N shape or a K shape, and their panels reside facially adjacent the walls of the bag. These embodiments provide similar advantages. Two or more supports can be connected together to provide larger numbers of compartments.

DESCRIPTION OF THE DRAWINGS

The invention can best be further described by reference to the accompanying drawings, in which.

DETAILED DESCRIPTION OF THE INVENTION

Figure 1:
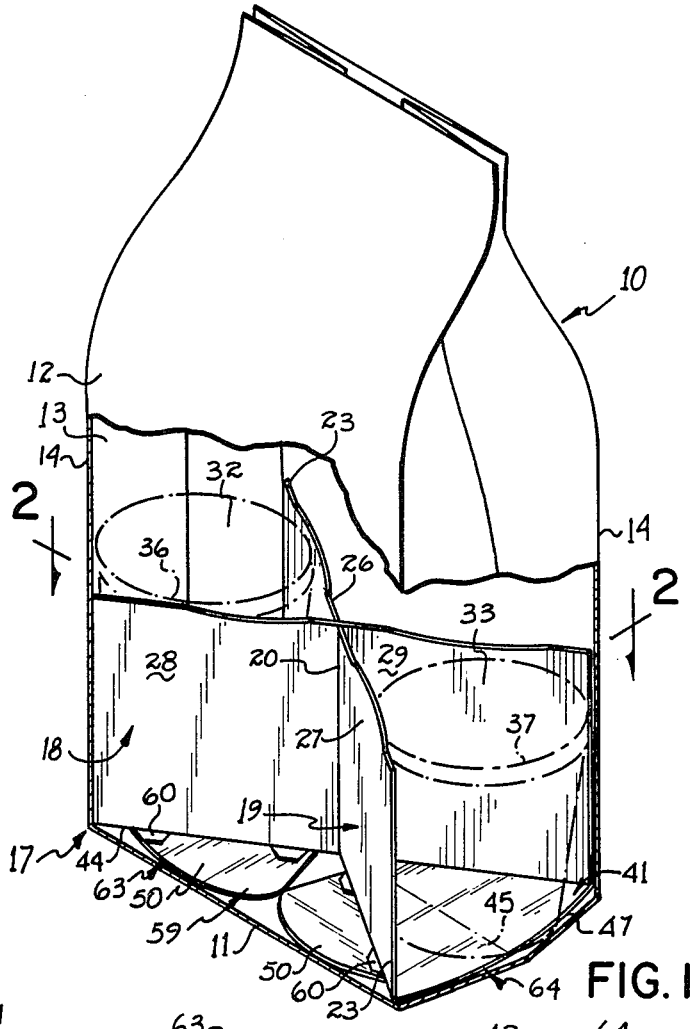
FIG. 1 is a perspective view, partly broken away, of a bag in which a preferred form of support has been erected.

The preferred embodiment of the support of this invention is illustrated in FIGS. 1–4, and can be used to carry one or more containers such as drink cups, bottles, cans or even potted plants. FIG. 1 shows the support 17 in open position in a conventional sack 10 of a type widely used in restaurants and food shops for carry out purchases, for example a twelve pound bag which has a nominal bottom size of 7 ×4½". Bag 10, which may be of paper, plastic or the like, has a generally rectangular bottom 11, side walls 12 and end walls 13 which meet at bag edges 14. (As used herein the term "bag" is meant to include cartons and other similar holders of flimsy construction). Support 17 comprises two generally rectangular panels 18 and 19 which are joined together along a vertical hinge line or join line 20 at their respective midlines. The panels 18 and 19 have reversed (upwardly and downwardly extending) slots 57 and 58 which each extend half the height of the panels (see FIG. 4) and which will interfit to join the panels; alternatively, the panels may be joined adhesively, similar to the glued hinge line at 75 in FIG. 7. In either case the panels are hinged together for swinging movement about line 20.

Figure 2:
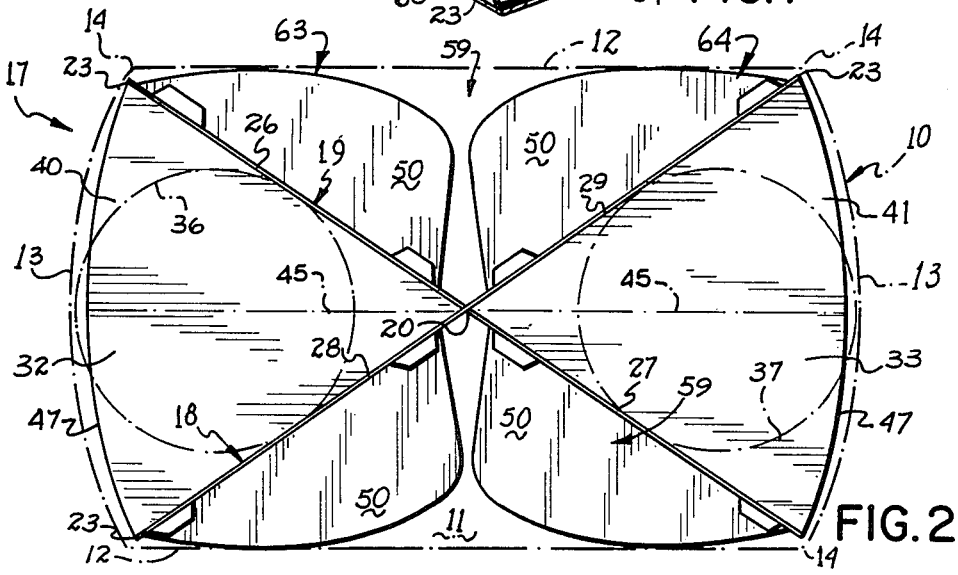
FIG. 2 is a horizontal section taken on line 2—2 of FIG. 1.

In the erected configuration the panels, as viewed in plan (FIG. 2) form an X. In the collapsed configuration the panels lie essentially parallel to one another, in facial proximity. As shown in FIG. 2, the length of each panel is about ⅛ - ⅜ inch less than the diagonal distance between the bag edges 14, 14, so that when erected in the bag that the vertical ends 23 of panels 18 and 19 will engage and be seated in the edges 14 of bag 10.

The panel portions between the vertical ends 23 and join line 20 are referred to herein as partitions 26, 27, 28 and 29. As can be seen in the preferred embodiment, partitions 26 and 27 are simply integral adjacent halves of panel 19; and partitions 28 and 29 are adjacent halves of panel 18. The pairs of partition which are adjacent the respective bag end walls 13, 14, form two endwise drink cup-receiving compartments 32 and 33. Compartment 32 is presented between adjacent partitions 26 and 28; and compartment 33 is presented between partitions 27 and 29. Because the bag is rectangular and the panels lie along the diagonals of the bag, each compartment, as seen in plan, is wedge-shaped and forms an acute angle at its apex. (If proportioned for use in a bag having a square floor, the partitions would form four compartments, all having substantially similar shapes). Each compartment 32 and 33 is sized so that a drink cup, indicated by the dashed lines 36 and 37, when inserted within it, engages and is supported at spaced positions on the two partitions and by the bag end (see FIG. 2). The support itself is open ended; the bag end walls 13 form the ends for the compartments. Thus the drink cup is securely positioned and cannot tip within the bag compartment; and the support, neatly engaging the corners of the bag is stable and maintains the bag open.

The compartments 32 and 33 have separate floors 40 and 41 which need not, and preferably do not (for reasons that will become apparent), extend across the join line. Each floor is preferably secured between the two partitions, being hinged to them along their bottom edges 44 (see FIG. 3). Each floor has a central fold 45 which bisects the apex angle between the partitions of the compartment (see FIGS. 2 and 3). The floor is pie shaped in plan and forms a bottom for substantially the entire compartment area. The end 47 of the floor fits neatly along the end wall of the bag.

Figure 3:
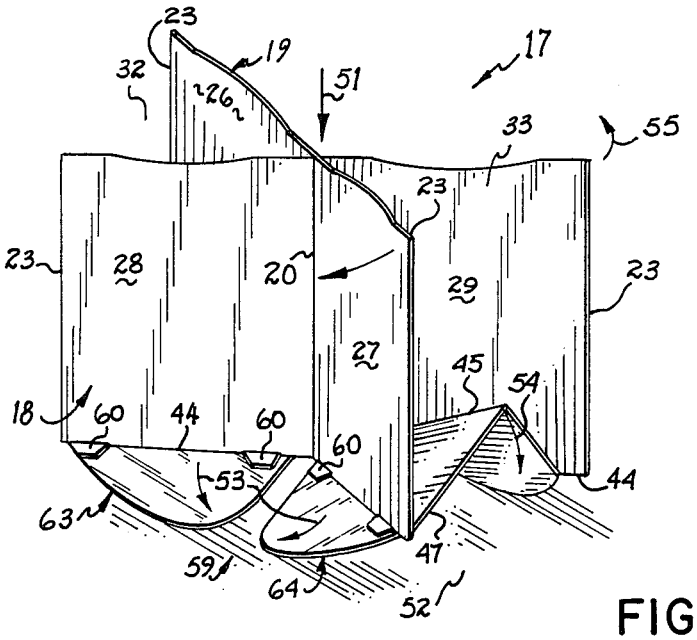
FIG. 3 is a diagrammatic perspective illustrating the manner in which the cam tabs cause the partitions to swing apart as the support is opened.

Referring to FIG. 3, in collapsed (i.e., folded) configuration the cooperating partitions lie facially adjacent one another and the floors 40 and 41 are folded upwardly in a vertical plane between them, so that the thickness of the collapsed support is little more than the actual thicknesses of the separate pieces of which it is made, and storage space is minimized. From closed configuration, the support is opened by swinging the partitions apart (FIG. 3). The floor folds downwardly until it extends horizontally between the partitions and lies facially against the bottom 11 of bag 10. In this position the floor provides additional support for the drink cups, moreover it helps protect the bag bottom from being weakened by condensation or spillage from the cups.

If desired, food can be placed in unused spaces between the compartments, or it can be placed on top of the cups for carrying. A separate cardboard floor can be set on the cups if desired to better insulate food from the drinks below them.

In order to facilitate the erection of the support in the bag, I prefer to provide cam tabs 50 at the lower edge 44 of each partition, outwardly of the floor. A cam tab 50 is preferably formed integrally and coplanar with the respective floor on each side thereof. In the partly open support, the four cam tabs project downwardly and outwardly from the respective compartment 32 or 33 (see FIG. 3). When the support is pushed down on a surface 52, as indicated by the arrow 51 in FIG. 3, the cam tabs 50 engage the surface 52 (which may be the bag floor) and, by reason of their angulation, tend to be spread apart in the direction of the arrows 53 in FIG. 3. Since each cam tab is coplanar with the adjacent half of the floor which lies between the partition and the fold line 45, outward and upward swinging movement of the cam tab swings the floor down (arrow 54 in FIG. 3). As the floor folds downward it causes the panels to swing apart to the erected position (arrows 55). Thus the provision of the cam tabs greatly facilitates opening the support inside a bag, and in fact this can easily be done with one hand. It should be appreciated that the cam tabs are not required; they are not needed to support drink cups, in fact they lie outside the cup compartments 32 and 33. However, the cam tabs of themselves provide a kind of floor in the two spaces 59, 59 between the compartments, and these spaces can also be used to carry two more cups or food, depending on bag and support size and shape. The drink cups may not fit into these spaces 59, 59 so snugly because (for common bag sizes) the spaces have oblique angles at their apexes and the cups are not so closely confined, although more securely than if the support were not used.

Figure 4:
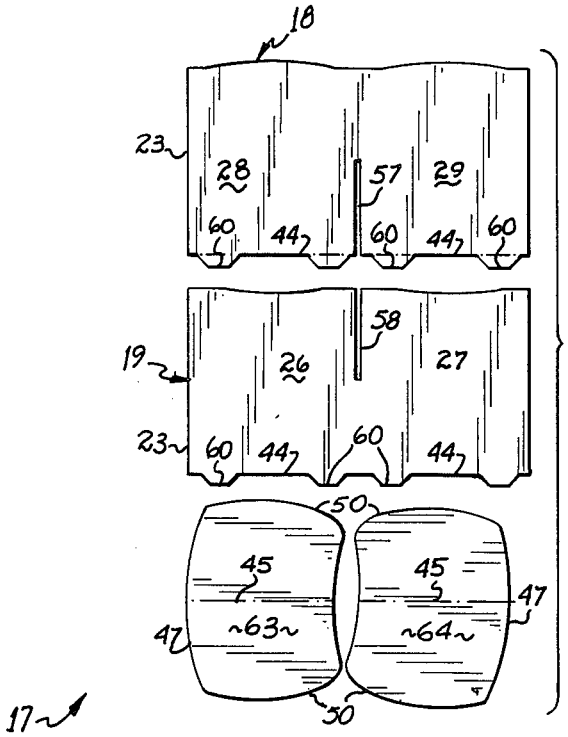
FIG. 4 is a plan view of a presently preferred set of blanks for constructing the embodiment of the invention shown in FIGS. 1-3.

The set of blanks shown in FIG. 4 is presently preferred for making the embodiment of FIGS. 1–3. The blank is made of light weight board, for example about 0.015 - 0.020 inch thick plain chipboard. Two panels are provided, one panel 18 being slotted upwardly at 57 from its lower edge 44, along its center line from the top, the other panel 19 being slotted downwardly at 58 so the slots can be interfitted. The connection provides the hinge action for opening and closing the support. Each panel has a series of glue tabs 60 along its lower edge 44 by which are secured the respective base elements 63 and 64. Each base element 63 and 64 provides both the floor and the cam tabs which project outwardly from the floor.

Figure 5:
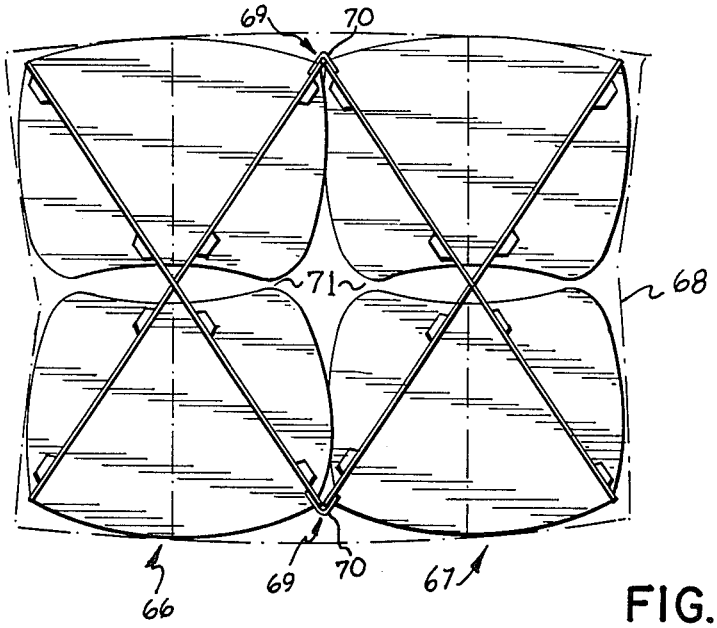
FIG. 5 is a plan view of an alternative embodiment of support in accordance with the invention, for holding a larger number of drink cups.

The support described above is particularly well suited for holding two drink containers, such as conventional 12 or 16 ounce cups, about 5–6" high. FIG. 5 shows an alternate form of support adapted for carrying a larger number of drink containers, and is for use with a larger size bag 68. This support is like a pair of two supports of the FIG. 1 type, and can be formed by securing two individual supports 66 and 67 in side by side relation so that their vertical edges adjoin one another, as at 69. Glue tabs or a line of tape 70 can be provided to secure the edges together Indeed, the stiffness of the material may be sufficient that the two inserts need not be connected. Each insert then holds two drinks, and a fifth drink can be set in the diamond shape center space 71 between them.

Figure 6:
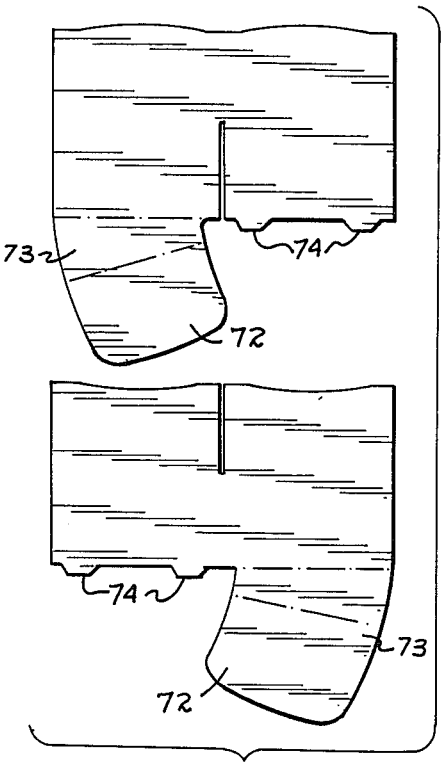
FIG. 6 is a plan view of a two piece blank for constructing an alternative embodiment of the invention.

FIG. 6 illustrates a two piece blank for assembling another alternative embodiment of the invention. This model differs in that, rather than having four cam tabs as in the embodiment of FIGS. 1–3, it has only two cam tabs 72, each formed integrally with a floor portion 73. The floor portion is in turn integral with one partition; the adjoining cam tab is secured to the other partition by glue tabs 74. Although this shape is less symmetrical, it requires less material and is cammed open in the same general manner as the preferred embodiment.

Figure 7:
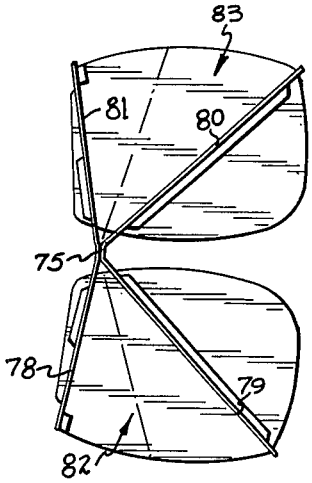
FIG. 7 is a plan view of an open support in accordance with yet another embodiment of the invention.

FIG. 7 illustrates yet another embodiment of the support, adapted for carrying one, two or three cups and food. In this instance the partitions 78–81, rather than forming an X (as seen in plan) like the first embodiment, form the shape of the letter K. The two partitions 78 and 81 can be parts of a single panel; they are coplanar or only slightly angulated at the join line 75, and in use they reside almost facially against the side wall of the bag, not shown. The drink compartments 82 and 83 are off center, for which reason this embodiment is less preferred although still quite effective for use.

Figure 8:
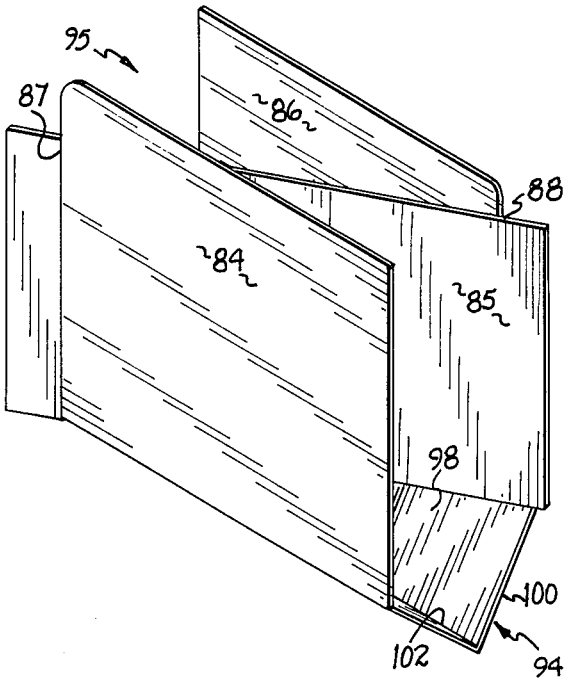
FIG. 8 is a perspective view of another alternative embodiment of the invention.
Figure 9:
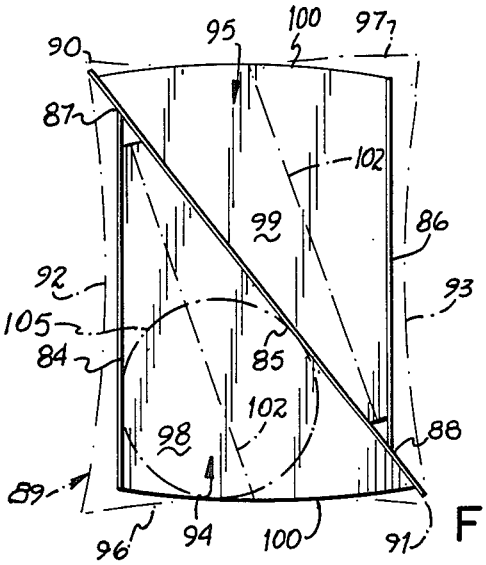
FIG. 9 is a plan view of the support shown in FIG. 8.

FIGS. 8 and 9 of the drawings show another embodiment wherein three panels are connected to form an N shape when erected, as viewed in plan. This embodiment provides two container compartments and is particularly useful with smaller size bags, for example 6 lb. bags (which have a nominal bottom size of about $6\times3\frac{3}{8}$"), and 8 lb. bags (which have a bottom size of about $6\frac{1}{8}\times4\frac{1}{8}$"). This embodiment comprises three vertical panels or partitions 84, 85 and 86, the outer panels 84 and 86 being similar to one another and hinged to the center panel 85 along two hinge lines 87 and 88 respectively. Thus each pair of panels is joined on a hinge line, the three panels being joined on two hinge lines. The hinge lines are adjacent to but not necessarily at the vertical edges of center panel 85. The center panel 85 is sized to fit into a bag, indicated by the dashed line 89 in FIG. 9, along a diagonal line between opposite corners 90, 91 of the bag. The outer panels 84 and 86 lie inside and roughly parallel to the sidewalls 92 and 93 of the bag. Panels 84 and 85 define one open-ended compartment 94 between them; and panels 85 and 86 define a second similar compartment 95 between them. The two compartments are closed in use by the respective end walls of the bag, as indicated by the dashed lines 96 and 97. An essentially pie shaped floor 98 is connected between the bottom edges of panels 84 and 85, and a similar floor 99 is connected between the bottom edges panels 85 and 86. The outer edges or ends 100, of floors 98 and 99 fit neatly inside the respective ends of the bag and, together with the diagonally extending central panel 85, maintain the bag in open condition.

Each floor 98 and 99 is creased along a center line 102 and may be folded either downward or upward to collapse the support; in FIG. 8 floor 98 is shown as folding downward in a vertical plane between the two panels 84 and 85. If the floors are folded downward in closed configuration, then when the support is inserted into a bag 89, the floor folds 102 first engage the bottom of the bag 89 and tend to cam the panels apart to erect the support. It will be appreciated that downwardly folding compartment floors may be employed in other embodiments if desired; this provides the caming function of the cam tabs, although cam tabs, if provided, further rigidify the bottom of the bag over areas outside the container receiving compartments. The positions of the hinges lines 87 and 88 on opposite sides of the center panel 85, is calculated to provide compartments 94 and 95 of such size so that a cup or other container 100 indicated by a phantom line 105 in FIG. 9, will be supported horizontally at three points: where it engages the outside panel, the center panel and the end wall of the bag. This three point support tends to prevent movement of the cup in the compartment.

For carrying more than two containers, the "N" design can be extended by the addition of additional panels, to form a series of connected Ns. The resulting support is thus like two smaller supports joined together.

Having described the invention, what is claimed is:

1. A container support which is insertable into a bag to enable at least two containers to be carried upright in the bag, said support comprising, at least two panels which are hinged together along at least one join line, said panels being oriented vertically in use and having bottom edges which are coplanar and vertical edges, said join line or lines demarcating at least three partitions on said panels, said partitions extending from said join line or lines to said vertical edges, said panels being swingable in hinged relation about said join line or lines, between a collapsed configuration in which they are essentially parallel to one another, and an erected configuration in which they extend at an angle to one another and form at least two container-receiving compartments between adjacent partitions, each said compartment being open at the vertical edges of the respective partitions, each such compartment having a container-supporting floor which is hinged to the bottom edge of at least one of the partitions which form it, each said floor being foldable in a vertical plane with respect to the partition to which it is hinged to lie substantially parallel thereto in said collapsed configuration, and to extend perpendicularly with respect thereto in said erected configuration, toward the other partition which forms the respective compartment.

2. A container support in accordance with claim 1 wherein each said floor is connected between both of the two partitions which form the respective compartment, each said floor having a crease which bisects the angle between said partitions in the erected configuration, said floor being foldable along said crease between an erected position in which the floor extends perpendicularly between the bottom edges of said two partitions, and a collapsed position in which the floor is folded in a vertical plane which lies between said two partitions, swinging of the panels about said join line from said collapsed configuration to said erected configuration unfolding said floor and moving it to its erected position, in which latter position the floor holds said two partitions apart.

3. A container support in accordance with claim 1 wherein the support comprises two panels a single join line is located centrally on each said panel, and said panels vertically intersect one another along said join line.

4. A container support in accordance with claim 3 wherein said panels form the shape of the letter X, as viewed in plan in said erected configuration.

5. A container support in accordance with claim 1 comprising a central panel having opposite ends, and two outer panels which are hinged to said center panel adjacent the opposite ends, said panels form the shape of the letter N, as viewed in plan in said erected configuration, and two said compartments are presented between said center panel and the respective outer panels.

6. A container support in accordance with claim 1 wherein said panels form the shape of the letter K, as viewed in plan in said erected configuration.

7. A container support in accordance with claim 1 wherein each said panel has a slot along said join line which extends for part of the height of the panel, and one panel is inserted into the slot of a second other panel, thereby hinging them together.

8. A container support in accordance with claim 1 further including at least one cam tab extending outwardly from a partition, in position such that when said support in said collapsed configuration is pushed down into a bag, the cam tab will engage the bottom of the bag and will cam the partitions apart, thereby transforming said support into its erected configuration.

9. A container support in accordance with claim 8 wherein said cam tab is a coplanar extension of said floor, and unfolds the floor as the cam tab engages the bottom of the bag.

10. A container support in accordance with claim 1 comprising two such supports, assembled in side-by-side relation, thereby providing more such compartments.

11. A bag having a bottom and four walls which define corners between them, and a container support erected inside said bag, at least one container being receivable in said support to be carried upright in the bag, said support comprising, at least two panels which are connected along a join line, said panels being oriented vertically in said bag, said panels having coplanar bottom edges which are supported by the bottom of the bag and vertical edges which are parallel to one another, said panels defining partitions which extend from said join line to said vertical edges, at least some of said vertical edges being seated in corners of the bag, at least one said partition spaced from the walls of said bag and extending into a corner of the bag, said panels being swingable in hinged movement relative to one another between a collapsed configuration in which they are essentially parallel to one another, and an erected configuration in which said panels extend angularly to one another and form container-receiving compartments between them, each said compartment being closed outwardly by a single wall of said bag, each compartment of said support having a container-supporting floor which is connected to the bottom edge of at least one of the partitions which form it, said floor having a fold line extending from said join line and being foldable along said fold line in a vertical plane with respect to the partition to which it is hinged, to lie substantially parallel thereto in said collapsed configuration, and to extend perpendicularly with respect thereto in said erected configuration, toward the other partition which forms the respective compartment.

12. The bag and support of claim 11 wherein at least one of the panels lies along a diagonal of the bag, between diagonally opposite corners thereof, and said panel comprises two adjacent partitions having vertical edges which are seated in corners of the bag.

13. The container support of claim 1 wherein each said floor has an outer edge which extends in a line between the bottom edges of the partitions of the respective compartment.

14. The bag and container support of claim 11 wherein said one partition extends from one corner of the bag into a diagonally opposite corner of the bag.

15. The bag and container support of claim 14, wherein said support, as viewed in plan, is in the form of an X and has two panels which extend diagonally between respective opposite corners of the bag.

16. The bag and container support of claim 14, wherein said support, as viewed in plan, is in the form of an N and comprises three partitions, two of which facially engage opposite sides of said bag, and the third of which extends across said bag from one corner thereof to a diagonally opposite corner thereof.

17. The bag and container support of claim 11, wherein said support, as viewed in plan, is in the form of a K and comprises two panels, there being one join line along the midlines of both said panels, said join line defining four partitions, two partitions extending from said join line across the bag into corners of an opposite side of said bag.

* * * * *